US007377275B2

(12) United States Patent
Myer

(10) Patent No.: US 7,377,275 B2
(45) Date of Patent: May 27, 2008

(54) IMITATION STONE CUTTER

(76) Inventor: C. Martin Myer, 2707 33rd Trail NE., Olympia, WA (US) 98506

( * ) Notice: Subject to any disclaimer, the term of this patent is extended or adjusted under 35 U.S.C. 154(b) by 0 days.

(21) Appl. No.: 11/482,784

(22) Filed: Jul. 6, 2006

(65) Prior Publication Data

US 2008/0006257 A1 Jan. 10, 2008

(51) Int. Cl.
*B28D 1/32* (2006.01)

(52) U.S. Cl. ..... 125/23.01; 125/40

(58) Field of Classification Search ..... 125/23.01, 125/23.02, 24, 40

See application file for complete search history.

(56) References Cited

U.S. PATENT DOCUMENTS

| | | | | |
|---|---|---|---|---|
| 600,856 A | | 3/1898 | Brinkman | |
| 812,973 A | | 2/1906 | Barr et al. | |
| 1,805,163 A | | 5/1931 | Buckner | |
| 2,053,043 A | | 2/1936 | Patterson | |
| 2,626,664 A | | 1/1953 | Regele | |
| 2,712,169 A | | 7/1955 | Buttress | |
| 2,874,688 A | * | 2/1959 | Biesanz, Sr. et al. | 125/23.01 |
| 2,933,079 A | * | 4/1960 | Gutting | 125/23.01 |
| 3,161,190 A | | 12/1964 | Stephens et al. | |
| 3,886,927 A | | 6/1975 | Chattin | |
| 5,547,001 A | * | 8/1996 | Cumming et al. | 144/195.4 |
| 5,662,094 A | * | 9/1997 | Giacomelli | 125/23.01 |
| 6,079,304 A | | 6/2000 | Bisceglia | |
| 7,107,982 B1 | * | 9/2006 | Lechner | 125/23.01 |
| 2003/0089363 A1 | * | 5/2003 | Suto et al. | 125/23.01 |

* cited by examiner

*Primary Examiner*—Dung Van Nguyen
(74) *Attorney, Agent, or Firm*—Brian J. Coyne

(57) ABSTRACT

A device for precise cutting of imitation stone. An upper blade is mounted to an upper blade mount assembly for vertical sliding movement over a stationary lower blade. Downward movement of a handle rotates a cam surface that engages a convex upper surface of the upper blade mount assembly. This action moves the upper blade into contact with a piece of imitation stone disposed between the upper and lower blades, and further lowering of the upper blade then cuts the stone. The cutting edge of each of the blades is beveled on one side only such that each of the blade edges is asymmetrical in vertical cross-section.

5 Claims, 6 Drawing Sheets

IMITATION STONE CUTTER

CROSS REFERENCE TO RELATED APPLICATIONS

None

STATEMENT REGARDING GOVERNMENT SPONSORED RESEARCH

None.

BACKGROUND OF THE INVENTION

1. Field of the Invention

This invention relates to devices for cutting stone accurately to shape, and more particularly for cutting imitation stone at a building construction site for use in bathroom and kitchen counters, floors, walls, fireplaces, patios, cobblestone walkways, and for a variety of other applications.

2. Description of Related Art

Natural stone is a highly desired construction material, but its use entails high labor and shipping costs. Imitation stone, also known as manufactured stone, has been used for over thirty years and is commonly substituted for natural stone because of its low shipping and installation cost, high quality, and low weight. Imitation stone is made from poured concrete, pumice, and special high-quality, long-lasting permanent pigments. Imitation stone is typically adhered to a wall surface with a cement stucco mixture that is often very rich in Portland cement; in contrast, natural stones are set on top of one another. It is usually necessary to trim and shape imitation stones preparatory to their installation in a wall or other setting.

Prior to my invention, there existed no satisfactory cutting device for imitation stone. Stone and tile cutting devices that require a percussive blow were disclosed in U.S. Pat. No. 3,886,927 to Chattin and U.S. Pat. No. 812,973 to Barr et al., respectively, but a percussive blow risks shattering imitation stone. U.S. Pat. No. 600,856 to Brinkman disclosed a tile cutting machine that used a movable upper and a fixed lower blade aligned in a cutting plane, each blade having serrated teeth, wherein the upper blade was movable between a pair of upright standards and actuated by means of toggles by movement of a hand lever. I have found, however, that one obtains a more precise and even cut of imitation stone if the upper and lower blades each have a smooth edge instead of a serrated edge, and if the edges are asymmetrical in vertical cross-section and are oppositely canted with respect to the cutting plane, as explained below. U.S. Pat. No. 2,053,043 to Patterson disclosed a stone cutting machine that employed a crank disk to actuate movement of an upper blade by means of toggles; the cutting edges of the upper and lower blade were V-shaped—that is, each blade edge was symmetrical in vertical cross-section. U.S. Pat. No. 6,079,304 to Bisceglia disclosed a pinch blade tool, intended for trimming shingles, having a stationary blade and a movable blade that moved with a sliding action to pinch work between the blades, but did not teach the use of asymmetrical blade edges.

My cutter employs a single pair of apposed cam surfaces for imparting, by downward movement of a handle, a gradual and uniform downward cutting motion to an upper blade thereof. U.S. Pat. No. 1,805,163 to Buckner disclosed a belt cutter that had two, laterally spaced-apart pairs of apposed cam surfaces, linked for unitary motion by a connecting link, for moving an upper, cutting blade downward through a work piece (belt). U.S. Pat. No. 2,626,664 to Regele also employed a dual cam drive in combination with an upper blade that was inclined with respect to the lower blade; the upper blade simultaneously descended and swung lengthwise the lower blade to achieve a progressive cut. Dual cam drives, such as those of Buckner and Regele, are unnecessarily complex and expensive for an imitation stone cutter. A single cam drive in combination with my improved blade edges provides a simpler, less expensive and more robust cutter.

SUMMARY OF THE INVENTION

My imitation stone cutter includes a lower blade mount assembly, which assembly includes means to support an imitation stone while the stone is being cut. A lower blade is mountable to the lower blade mount assembly and has a top cutting edge. The top cutting edge has a canted, asymmetrical wedge shape in vertical cross-section. Extending upward from the lower blade mount assembly is a vertically-elongated standard. An upper blade mount assembly is slidably mounted to the standard for vertical movement between a first, upper position and a second, lower position. An upper blade is mountable to the upper blade mount assembly in a common cutting plane with the upper blade. The upper blade has a bottom cutting edge that has an asymmetrical wedge shape in vertical cross-section and is canted oppositely to the top cutting edge of the lower blade. That is, with respect to the cutting plane, the top cutting edge of the lower blade and the bottom cutting edge of the upper blade are mirror opposites. An actuator mount assembly is attached to the standard above the upper blade mount assembly. Actuator means is attached to the actuator mount assembly for forcing the upper blade mount assembly down from the first, upper position to the second, lower, cutting position. Spring return means urge the upper blade mount assembly upward toward the actuator mount assembly.

In a preferred embodiment, the upper blade mount assembly has a tubular rear end portion and an opposite, front end portion. Thus, while assembling the cutter and prior to attaching the upper blade mount assembly to the standard, the upper end of the standard is inserted through the tubular rear end portion of the upper blade assembly in order to slidably mount the upper blade assembly on the standard. In a further preferred embodiment, a single pair of apposed cam surfaces is employed for imparting, by downward movement of a handle, a gradual and uniform downward cutting motion to the upper blade. To this end, the actuator mount assembly has a rear end portion attached to the standard and an opposite, front end portion that terminates in a clevis. The actuator means includes a transversely-apertured cam plate pivotably attached by a clevis pin to the clevis for rotation in a vertical plane. The cam plate has a convex bottom cam surface. A front portion of the cam surface of the cam plate extends farther away from the clevis than a rear portion thereof. Adjacent to, and just below the cam surface of the cam plate is a front end portion of the upper blade mount assembly, which has a convex top surface. Downward movement of a handle that extends forwardly from the cam plate causes the cam surface of the cam plate to rotate into contact with, and thereafter to force downward, the convex top surface of the front portion of the upper blade mount assembly—which causes the entire upper blade mount assembly to slide downward along the standard. In this manner, the upper cutting blade, coacting with the stationary lower blade, cuts through imitation stone positioned for cutting on the support means between the blades. The spring return means then raises the upper blade assembly and the handle back up to their original, elevated positions, ready to make the next cut. The spring return means is preferably a pair of coil springs vertically disposed on opposite sides of the cutter, each coil spring having an upper end attached to the actuator mount assembly and a lower end attached to the upper blade mount assembly.

Figure 1:
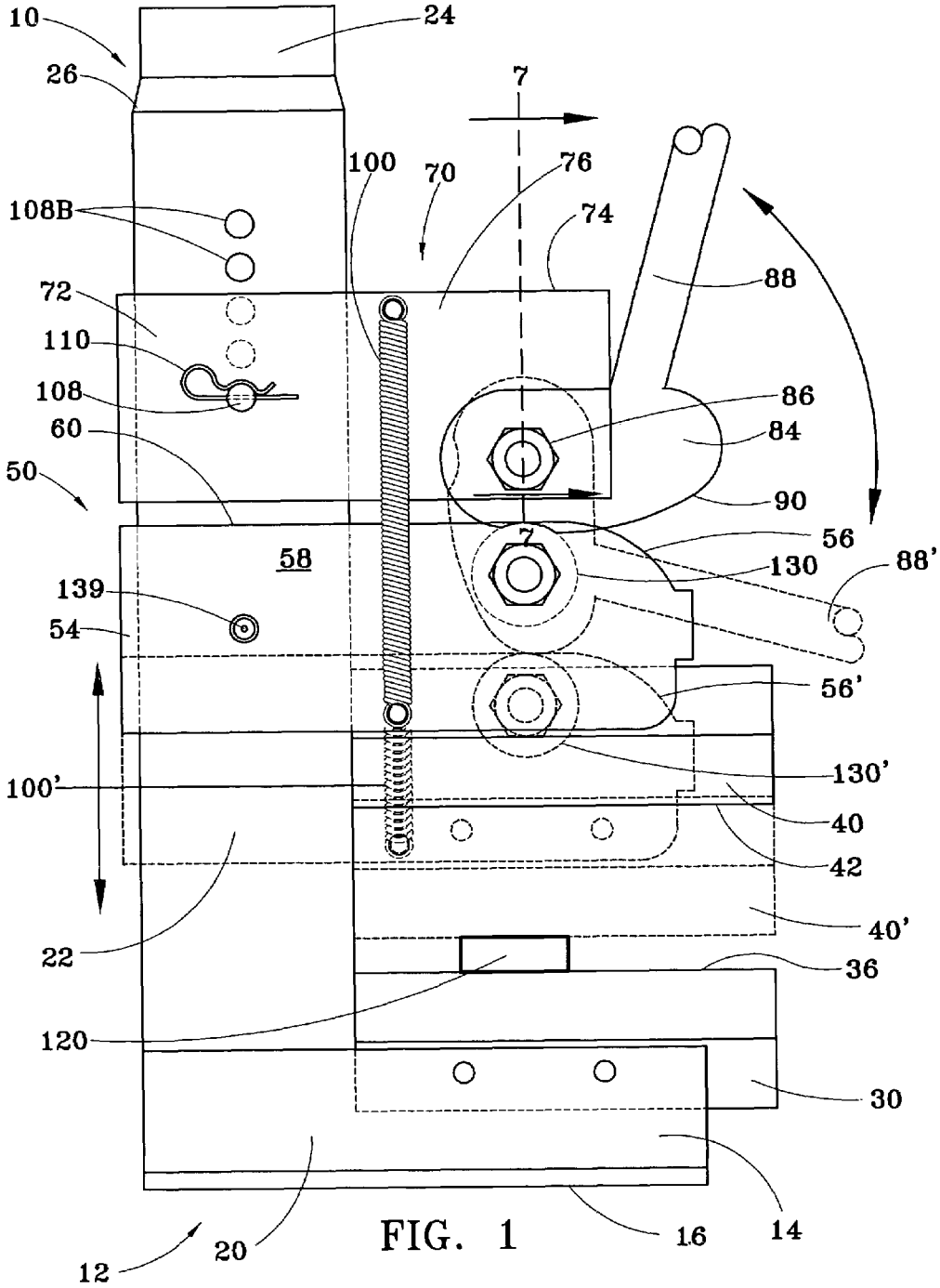
FIG. 1 is a left side elevation of my imitation stone cutter, with an imitation stone positioned on support means between upper and lower blades, with the actuator means and upper blade mount assembly shown in solid outline in a first, elevated position and in phantom outline in a second, lowered, cutting position.

Like numerals designate similar components and aspects of the invention throughout the several figures. Numerals that designate components depicted in an elevated position in FIG. 1 are designated by corresponding primed numerals where they are depicted in a lowered, cutting position; for example, whereas the handle elevated is designated by 88, the handle lowered is designated by 88'. The terms "left" and "right" refer, respectively, to the right and left portions of the cutter as depicted in FIG. 2.

DESCRIPTION OF THE PREFERRED EMBODIMENT

Figure 2:
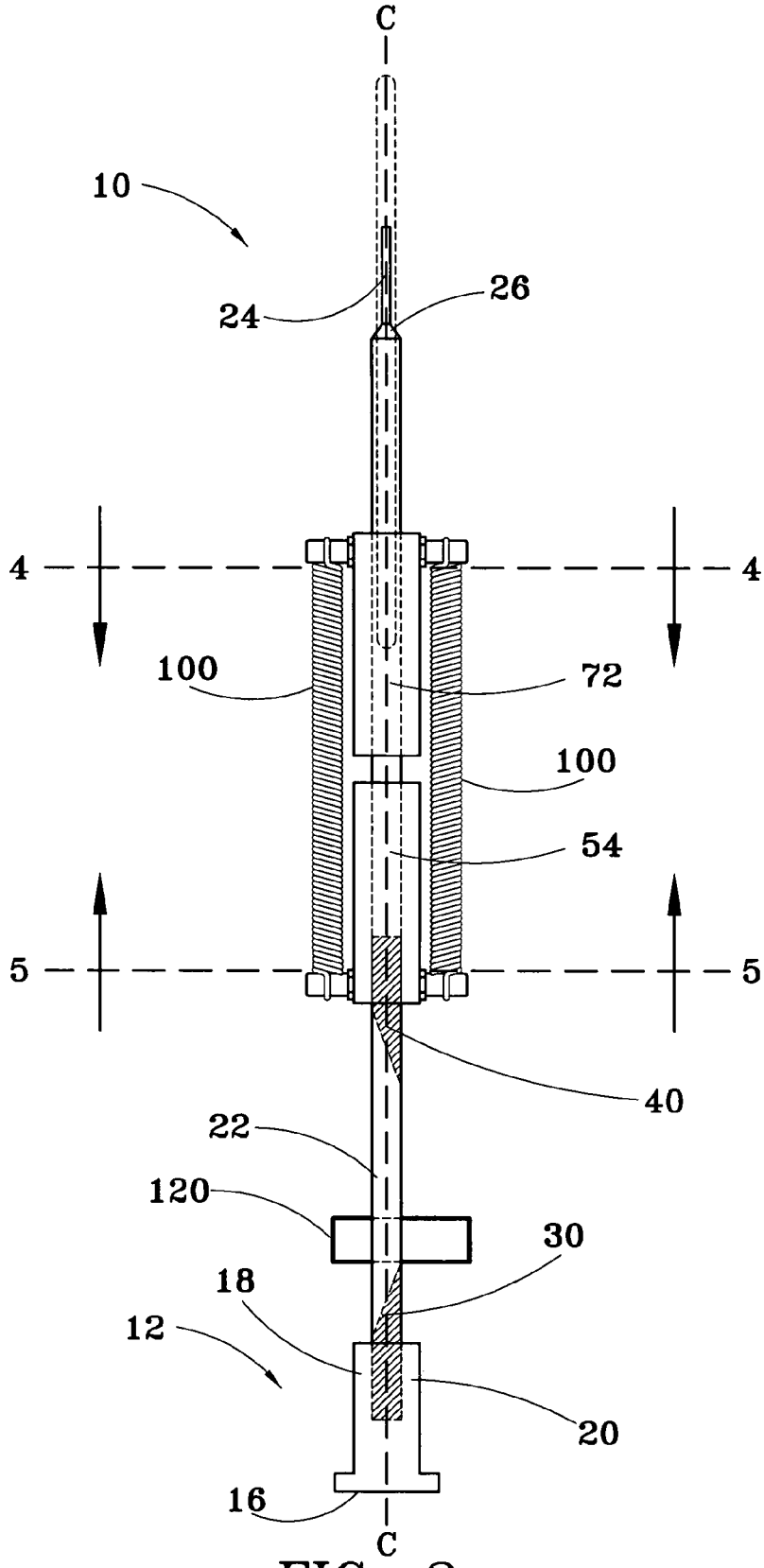
FIG. 2 is a rear view thereof, with the actuator means and upper blade assembly shown in elevated position, and with the phantom outline of the cutting position omitted for the sake of clarity.
Figure 5:
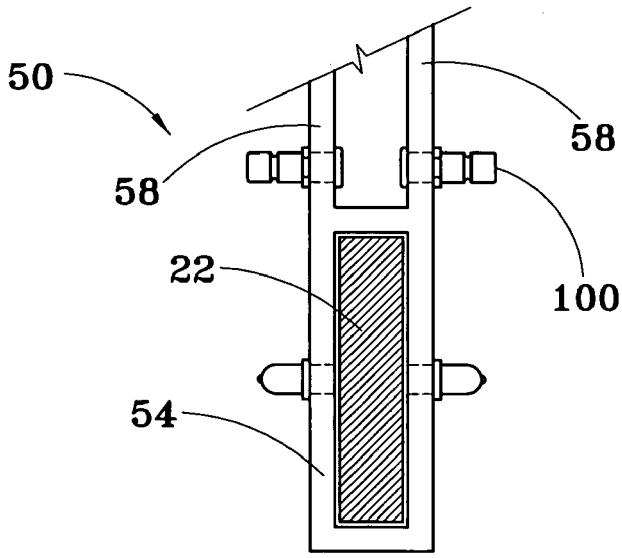
FIG. 5 is a horizontal cross-sectional view of the upper blade mount assembly and of the standard, taken along line 5-5 of FIG. 2.
Figure 6:
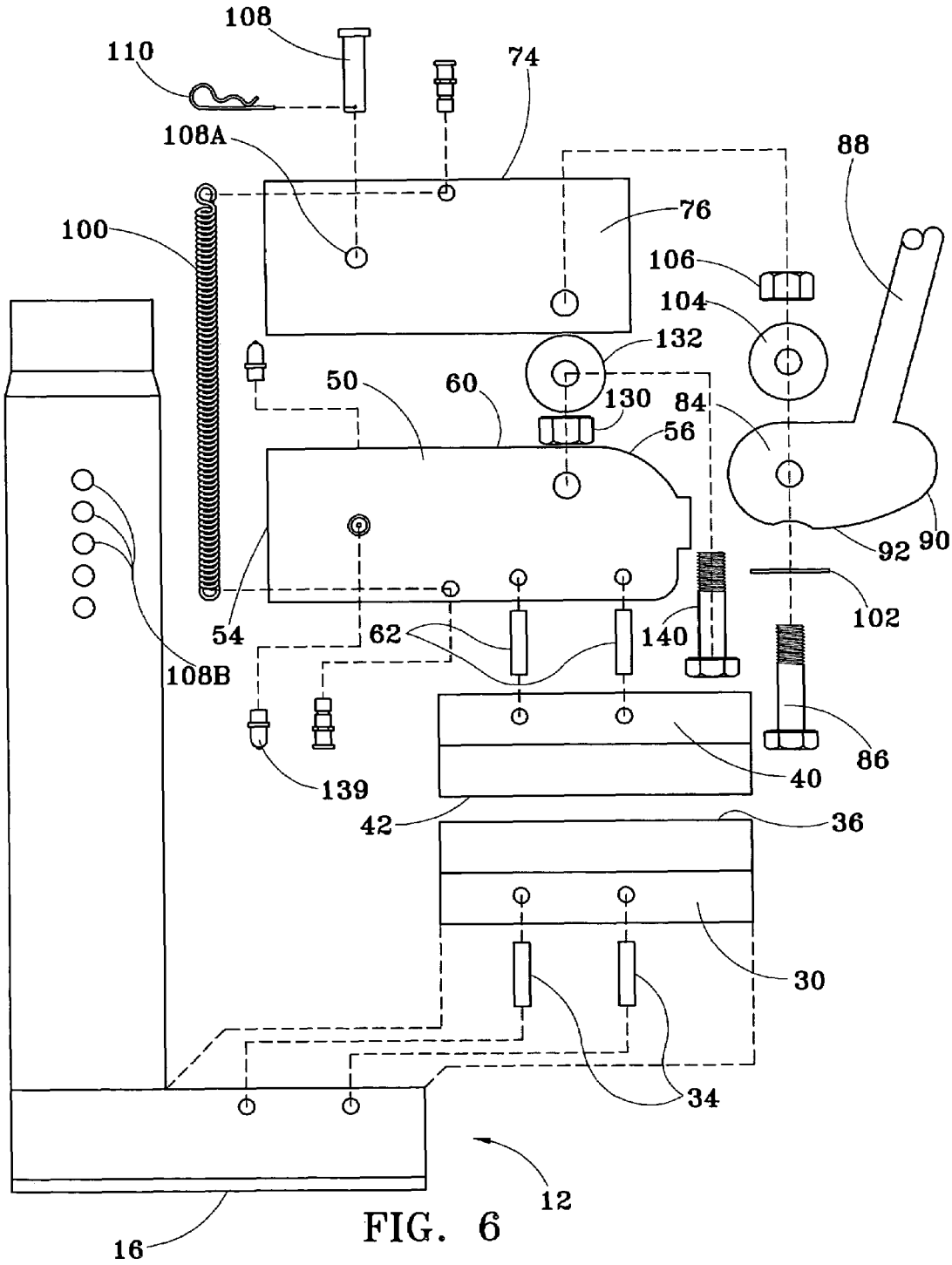
FIG. 6 is an exploded, left side view of my cutter.

Referring now to FIGS. 1-2, an imitation stone cutter 10 according to the present invention is depicted in left side elevation and rear elevation, respectively. A base 12 extends from a rear portion of the cutter forwardly and terminates in free front end 14. The base 12 comprises a flat bottom panel 16 and laterally spaced-apart, upstanding rails 18, 20 attached to an upper surface of the bottom panel 16. Attached to a rear portion of the base 12 is a vertically-elongated standard 22 that terminates in an upper, free end 24. The standard 22 is substantially uniform in its front-to-rear and lateral dimensions up to a beveled shoulder 26, but has above the shoulder reduced front-to-rear and lateral dimensions, which facilitate assembly of the cutter. A stationary, lower blade 30 is mounted between the walls 18, 20 of the base 12 by a pair of mounting screws 34 such that the blade 30 extends from the free end 30 of the base 12 rearward to the standard 22, as depicted in FIG. 6. The lower blade 30 has a top, cutting edge 36 that extends substantially the length of the blade. An upper blade 40 is similarly mounted parallel to the lower blade 30 by mounting screws 62 to an upper blade mount assembly 50 that is slidably mounted to the standard 22 above the base 12. The upper blade mount assembly 50 extends forwardly from a tubular, hollow rear end portion 54 thereof (FIG. 5) that is journalled onto the standard 22 and has an opposite, free, front end portion that has a convex top surface 56. The standard 22 has vertically spaced-apart, openings 108B for securing the actuator mount assembly 70 to the standard with a transverse pin 108 that inserts through oppositely-disposed apertures 108A in a tubular, rear end portion 72 of the actuator mount assembly, which pin 108 is itself secured by a cotter pin 110. The height of the actuator mount assembly 70 above the base 12 is thereby adjustable so as to adapt the cutter 10 to the size of stone 120 that is to be cut. The upper blade 40 has a bottom, cutting edge 42 that extends substantially the entire length of the blade and is mounted by mounting screws 62 within a laterally spaced-apart pair of apertured walls 58 of the upper blade mount assembly 50 that are joined by a top wall 60. A grease fitting 139 inserted through the rear portion 54 of the upper blade assembly 50 facilitates its easy movement up and down the standard 22. As may best be seen in FIGS. 1 and 6, an apertured roller 132 is rotatably mounted on a transverse pin 130 inserted through the apertured walls 58 of the upper blade mount assembly 50.

Figure 7:
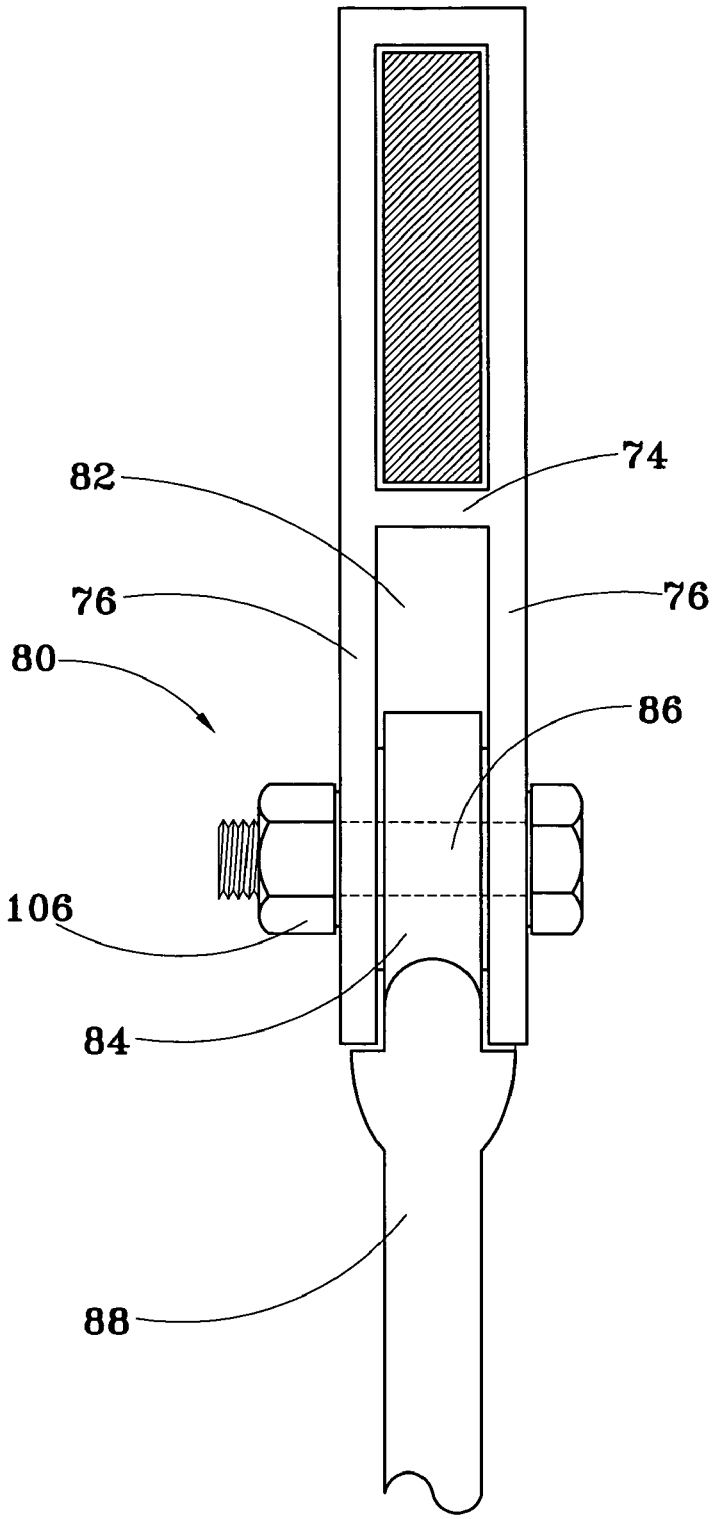
FIG. 7 is a vertical cross-sectional view of the actuator mount assembly taken along line 7-7 of FIG. 1.

The actuator mount assembly 70 further comprises a top wall 74 from which depend a laterally spaced-apart pair of side walls 76 and extends forwardly from the tubular rear end portion 72 journalled on the standard 22 to terminate at a front end portion thereof in a clevis 80, which clevis is depicted in transverse, vertical cross-section in FIG. 7. The clevis 80 includes front end portions of the top wall 74 and side walls 76, which together define a hollow space 82 into which is inserted a transversely apertured cam plate 84 that is pivotally attached to the side walls 76 by a clevis pin 86 for rotation in a vertical plane. Mounted on the clevis pin 86 are washers 102, 104 and a hex nut 106 threaded onto a free end thereof to secure the pin to the cam plate 84 and to the upper blade assembly 50. Extending forwardly from the cam plate 84 is a handle 88. The cam plate 84 has a convex bottom cam surface 90. A front portion of the bottom cam surface 90 extends farther away from the clevis pin 86 than a rear portion 92 thereof. A coil spring 100 having a lower end attached to a lug on the tubular rear portion 54 of the upper blade mount assembly 50 and an upper end attached to a lug on the tubular rear portion 72 of the actuator mount assembly 70 urges the upper blade mount assembly upward toward the actuator mount assembly and into a first, elevated position.

Figure 3:
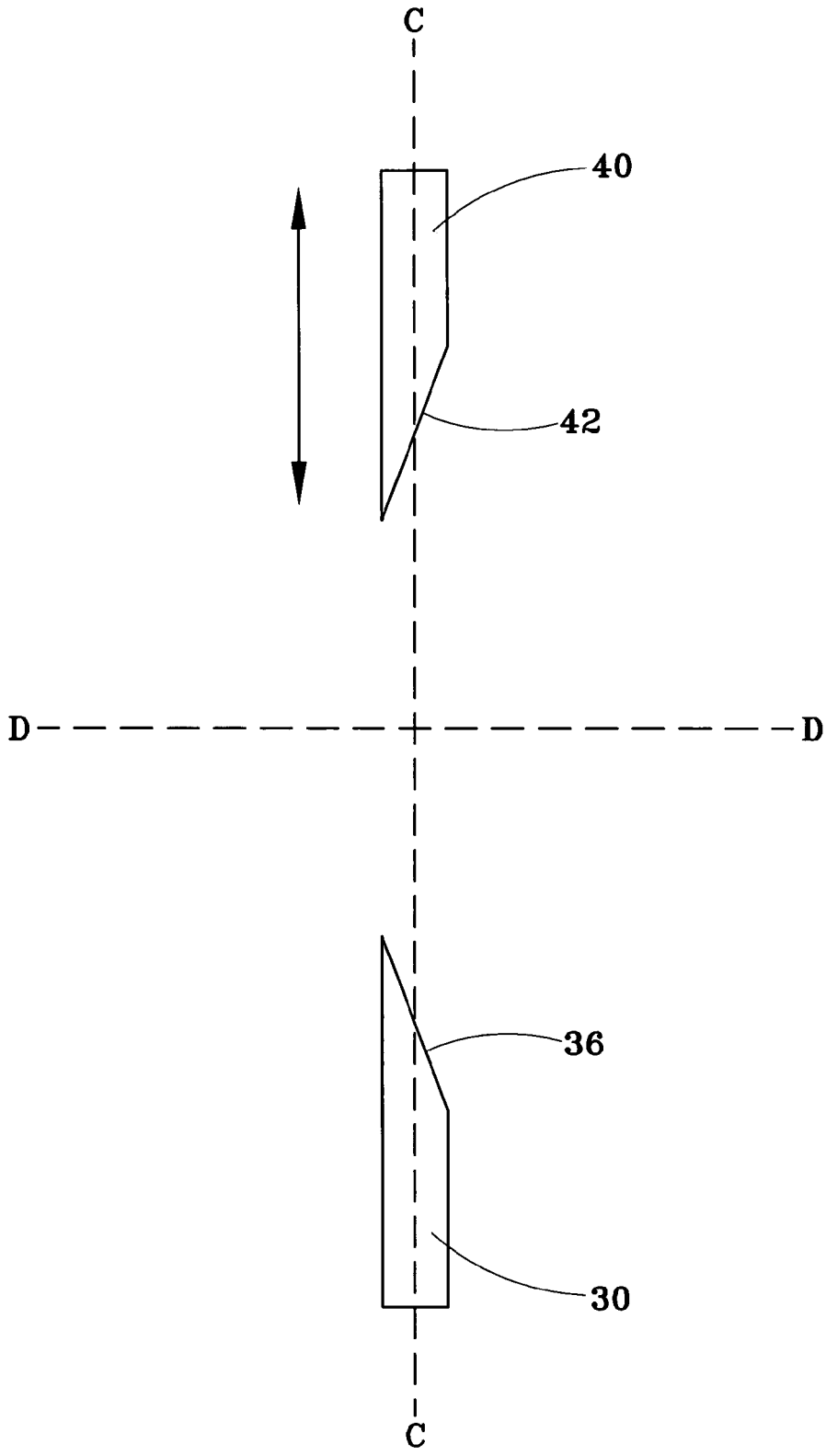
FIG. 3 is an enlarged, vertical cross-sectional view of the upper and lower blades of my cutter, aligned on a common cutting plane C-C and isolated from the remainder of the cutter for clarity.
Figure 4:
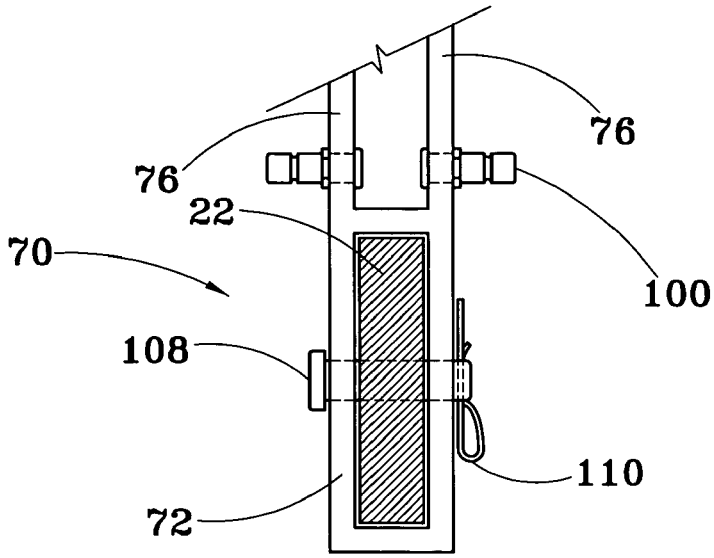
FIG. 4 is a horizontal cross-sectional view of the actuator mounting assembly and of the standard, taken along line 4-4 of FIG. 2.

Referring now to FIG. 3, the lower blade 30 and the upper blade 40 are aligned on a common, vertical cutting plane C-C. The lower blade cutting edge 36 and the upper blade cutting edge 42 are asymmetrical with respect to the common, cutting plane C-C and are instead symmetrical with respect to a horizontal plane D-D disposed intermediate the lower and upper blade edges 36, 42; that is, the blade cutting edges are mirror images of each other with respect to the plane D-D. Moreover, each of the lower and upper blade edges 36, 42 is asymmetrical in transverse, vertical cross-section. That is, unlike the V-shaped blade cutting edges commonly used in the past in stone cutters, one side only of each of the blade cutting edges 36, 42 of the present invention is beveled, and the blade side opposite side thereto is flat.

In use, with the handle 88 in a first, elevated position as depicted in solid outline in FIG. 1, a piece of imitation stone 120 is placed onto a front portion of the base 12 between the upper blade 40 and the lower blade 30. The handle 88 is then moved downward to a second, cutting position as depicted in FIG. 1 in phantom outline and denoted as 88.' Consequently, the cam plate 84 is thereby rotated such that its bottom surface 90 comes into contact with and depresses the convex top surface 56 of the front end portion of the upper blade mount assembly 50, and an upper margin of the roller 132 makes rolling contact with cam plate bottom surface 90, which forces the entire upper blade mount assembly downward and drives the upper, cutting blade 40 towards the lower blade 30, thereby cutting the stone 120. The coil springs 100 thereafter return the handle 88 and the upper blade mount assembly 50 to their initial, elevated positions, ready for the next cut.

From the foregoing description, it will be clear that the present invention may be embodied in other specific forms without departing from the spirit or essential characteristics thereof. Thus, the presently disclosed embodiments are therefore to be considered in all respects as illustrative and not restrictive, the scope of the invention being indicated by the appended claims, and not limited to the foregoing description.

I claim:

1. An imitation stone cutter, comprising:

a lower blade mount assembly, said assembly including means to support an imitation stone while the stone is being cut;

a lower blade mountable to the lower blade mount assembly and having a top cutting edge, said edge having a canted, asymmetrical wedge shape in transverse, vertical cross-section;

a vertically-elongated standard having a lower end and an opposite upper end, said lower end being rigidly attached to the lower blade mount assembly;

an upper blade having a bottom cutting edge, said cutting edge having an asymmetrical wedge shape in transverse, vertical cross-section that is canted opposite to the cant of the cutting edge of the lower blade, and said cutting edge being aligned in a common cutting plane with the cutting edge of the lower blade;

an upper blade mount assembly slidably mounted to the standard for vertical movement between a first, upper position and a second, lower cutting position, and adapted to receive and hold the upper blade above and parallel to the lower blade;

an actuator mount assembly attached to the standard above the upper blade mount assembly, wherein said actuator mount assembly has a tubular rear end portion attached to the standard and an opposite, front end portion that terminates in a clevis, and the front end portion of the upper blade mount assembly has a convex top surface; and actuator means attached to the actuator mount assembly for forcing the upper blade mount assembly down from said first, upper position to said second, lower, cutting position, wherein said actuator means includes a transversely-apertured cam plate pivotably attached by a clevis pin to the clevis for rotation in a vertical plane, said cam plate having a convex bottom cam surface, a front portion of said cam surface extending farther away from the clevis pin than a rear portion thereof, and an elongated handle that extends forwardly from the cam plate;

whereby, downward movement of the handle causes the cam surface of the cam plate to slide against the convex top surface of the front end portion of the upper blade mount assembly, forcing said upper blade mount assembly downward for cutting, and, thereafter, raising the handle returns the upper blade mount assembly to the first, upper position.

2. The cutter of claim 1, wherein the upper blade mount assembly has a tubular rear end portion and an opposite, front end portion, whereby, while assembling the cutter and prior to attaching the upper blade mount assembly to the standard, the upper end of the standard is inserted through the tubular rear end portion of the upper blade mount assembly in order to slidably mount the upper blade mount assembly on the standard.

3. The cutter of claim 2, further comprising a roller rotatably mounted to the front end portion of the upper blade mount assembly for rolling engagement with the convex bottom cam surface of the cam plate.

4. The cutter of claim 2, wherein the standard has vertically spaced-apart openings, and the tubular rear end portion of the actuator mount assembly has a pair of oppositely-disposed apertures that are registrable with said openings, and further comprising a transverse pin insertable through said openings and through said apertures to thereby permit adjustment of the height of the actuator mount assembly above the base.

5. The cutter of any of claims 1, 2, 3 and 4, further comprising spring return means including at least one coil spring having a first, upper end attached to the actuator mount assembly and a second, lower end attached to the upper blade mount assembly.

* * * * *